US009545550B2

(12) United States Patent
McQuiston

(10) Patent No.: US 9,545,550 B2
(45) Date of Patent: Jan. 17, 2017

(54) ADJUSTABLE GOLF CUP WITH PUTTABLE SURFACE

(71) Applicant: Aubrey Advisors LLC, New York, NY (US)

(72) Inventor: Kit McQuiston, New York, NY (US)

(73) Assignee: AUBREY ADVISORS LLC, New York, NY (US)

( * ) Notice: Subject to any disclaimer, the term of this patent is extended or adjusted under 35 U.S.C. 154(b) by 0 days.

(21) Appl. No.: 15/069,006

(22) Filed: Mar. 14, 2016

(65) Prior Publication Data

US 2016/0271468 A1 Sep. 22, 2016

Related U.S. Application Data

(60) Provisional application No. 62/135,073, filed on Mar. 18, 2015.

(51) Int. Cl.
*A63B 57/00* (2015.01)
*A63B 63/00* (2006.01)

(52) U.S. Cl.
CPC ..... *A63B 57/40* (2015.10); *A63B 57/357* (2015.10); *A63B 2063/002* (2013.01)

(58) Field of Classification Search
CPC . A63B 57/357; A63B 2063/002; A63B 57/40; A63B 63/00
USPC ..... 573/173–181, 185; 273/398–402
See application file for complete search history.

(56) References Cited

U.S. PATENT DOCUMENTS 2,933,318 A * 4/1960 Boynton ..... A63B 63/00 473/186
3,700,243 A * 10/1972 Kenney ..... A63B 57/357 206/315.9
4,150,826 A * 4/1979 Baldorossi ..... A63B 37/00 273/DIG. 20
4,660,834 A * 4/1987 Carrigan ..... A63B 69/3691 473/165
4,906,006 A * 3/1990 Sigunick ..... A63B 57/357 473/179
5,078,394 A * 1/1992 Kretz ..... A63B 69/3676 473/179
5,131,658 A * 7/1992 Grenon ..... A63B 63/00 473/185
5,390,917 A * 2/1995 Mendoza ..... A63B 69/3676 473/179
5,415,397 A * 5/1995 Van Holt, Jr. ..... A63B 57/357 473/179
5,776,004 A * 7/1998 Wilson ..... A63B 57/357 273/126 R
5,857,919 A * 1/1999 Hoyt ..... A63B 57/357 473/179
6,110,053 A 8/2000 Sjoeblom
7,914,387 B1 * 3/2011 Gugliotti ..... A63B 67/02 473/173
9,415,292 B2 * 8/2016 Reino ..... A63B 69/3676
2006/0079340 A1 * 4/2006 Niemczyk ..... A63B 69/3676 473/179

(Continued)

FOREIGN PATENT DOCUMENTS

WO WO-9715357 A1 5/1997

*Primary Examiner* — Mark Graham
(74) *Attorney, Agent, or Firm* — Wilson Sonsini Goodrich & Rosati

(57) ABSTRACT

An adjustable golf cup providing multiple cup diameters, a puttable upper surface, and advertising opportunity.

14 Claims, 2 Drawing Sheets

(56) References Cited

U.S. PATENT DOCUMENTS

| | | | | |
|---|---|---|---|---|
| 2009/0066027 | A1* | 3/2009 | Lauve | A63B 67/06 273/400 |
| 2010/0022318 | A1* | 1/2010 | Munaretto | A63B 57/357 473/196 |
| 2010/0331094 | A1* | 12/2010 | Graves | A63B 57/357 473/179 |
| 2011/0124428 | A1* | 5/2011 | O'Loughlin | A63B 57/357 473/196 |
| 2015/0165291 | A1* | 6/2015 | Ingle | A63B 67/06 273/400 |

* cited by examiner

ADJUSTABLE GOLF CUP WITH PUTTABLE SURFACE

CROSS-REFERENCE

This application claims the benefit of U.S. Provisional Patent Application Ser. No. 62/135,073, filed on Mar. 18, 2015, which is incorporated herein by reference in its entirety.

BACKGROUND OF THE INVENTION

It is estimated that the modern game of golf originated in 15th-century Scotland and has continued to grow into a popular sport that is widely played both on the amateur level and on the professional level. Currently, the game is played by approximately 25 million people in the United States and approximately 60 million people worldwide. There are approximately 17,600 golf courses in the United States and approximately 35,000 golf courses worldwide.

SUMMARY OF THE INVENTION

To increase the pace of play and to reduce the time needed to play a round of golf, golf course managers and owners contemplate an additional cup on the putting greens that will provide a second optional target for golfers. The second optional target will be a cup that is larger in diameter, significantly larger than the standard 4.25 inch cup. Typical golfers that target the larger cup will likely finish their game or round of golf in less time than typical golfers that target the standard 4.25 inch cup. However, having two target holes on the putting green simultaneously, one cup that is 4.25 inches in diameter and one larger, poses five significant problems. The first problem is that it presents a physical danger to the golfers playing on the putting green with two putting holes. It is common practice for a golfer to estimate the speed and direction that the ball must be struck in order to successfully hit the target cup. The golfer accomplishes this by walking the putting green in all directions while keeping their sight intently fixed on the ball path to the target cup. With a golfer's attention fixed on only one target hole, the potential to accidentally step into or trip on the second target hole is substantial. The larger target hole may be larger than the average foot size and creates a significant potential for serious injury to the golfer. The second problem is related to the first problem. The addition of a significant tripping hazard to the golf course will present the managers and owners of those golf courses with an elevated liability in operating their business. The third problem created by having two target holes on the putting green simultaneously is the increase in player disputes when the golf ball falls into the wrong golf hole in error. This will add confusion and diminish the enjoyment of the game. The fourth problem is related to the third problem. When the golf ball falls into the wrong golf hole in error, the pace of play is interrupted and is counter to the goal of increasing the pace of play with the addition of the larger second target hole. The fifth problem created is that the traditional rules of golf must be changed or re-written to address the complications of having two target golf holes on the putting green simultaneously.

An additional problem relating to advertising on the golf courses is solved by the invention. Golf course operators try to maintain the bucolic nature of the game by limiting visible signage and advertising materials. This desire to maintain the aesthetics of the golf course significantly limits the opportunity and methods available to market or to advertise to golfers. Advertising to golfers can generate income to golf course operators and can help offset the cost of operating the course. The operating costs of golf courses are primarily supplemented by dues and green fees paid by the golfer. Any savings created by additional advertising revenue could benefit both golfers and golf course operators. In addition to maintaining aesthetics and locating sources of new advertising revenue, operators need to increase the pace of play. To increase the pace of play, some golf course operators contemplate installing a golf cup that is 15 inches in diameter, a significantly larger and easier target to hit than the standard 4.25 inch cup. The invention solves the problem of increasing advertising revenue while maintaining the desired aesthetics of the golf course by introducing an advertising opportunity within a 15 inch golf cup. The size and flat bottom shape of a 15 inch cup provides an opportunity to market products and messages to golfers while they play the game. This is accomplished by inserting a flat water resistant ring that contains advertising messages into the flat bottom of a 15 inch cup. The advertising messages only become visible to a golfer when they are near or directly over the cup which helps maintain the desired aesthetics of the golf course.

Existing technologies were not created to solve any of the five problems identified herein. Nor do current technologies unintentionally solve any of the five problems identified herein. The existing technologies primarily focus on reducing the size of the standard 4.25 inch golf hole only for practice purposes. The goal of some existing technologies is to provide a training tool to golfers to improve putting accuracy, and is not intended to be incorporated into the actual playing of the game of golf. Further, if incorporated into playing the game of golf, the reduction in the size of the standard 4.25 inch golf hole would significantly reduce the pace of play, counter to the intended goal of incorporating a larger golf hole into the game of golf. The current technologies do not allow for a 15 inch hole to be incorporated into the game of golf.

Existing technologies also do not solve the problem identified herein. The current advertising technologies do not provide advertising devices designed to work, for example, in a 15 inch golf cup. No current advertising technology properly functions in a 15 inch golf cup and therefore cannot solve the problem intentionally or unintentionally. Some current technologies were designed specifically to fit and function within a 4.25 inch golf cup. The structure of the typical 4.25 inch golf cup is substantially different than the structure of the typical 15 inch golf cup. The two main differences relate to the shape of the two cups and the size of the two cups. The majority of the 15 inch golf cups have flat bottoms. The majority of, if not all of, the 4.25 inch golf cups have steeply angled bottoms. The 15 inch golf cup offers approximately 5.375 inches more in diameter on all sides of the cup than the 4.25 inch golf cup can offer. Some current technologies are designed with advertising rings that are less than 4.25 inches in diameter and are not designed to fit flush or flat on the bottom of the golf cup. They have parts that are designed with a significant angle or bowl shape in order to match the angled bottom of the typical 4.25 inch cup. Angled parts, bowl shapes and funnel shapes will not fit and or function in the flat bottom of the 15 inch cup.

The subject matter described herein eliminates the need to have two target golf holes on the putting green simultaneously and will therefore solve the five problems identified herein. The invention allows a single golf hole to be quickly and easily adjusted or converted from a 15 inch hole to a 4.25 inch hole while, in some embodiments, providing an entirely puttable surface. The invention also allows a single golf hole to be adjusted or converted from a 4.25 inch hole to a 15 inch hole. The invention allows owners and managers of golf courses to convert to a 15 inch hole to increase pace of play during times of high traffic or on specified days that can offer the "faster" version of the game. The invention also allows owners and managers of golf courses to convert to a 4.25 inch hole during times of lower traffic or on specified days that offer the "traditional" version of the game.

When converted to a 15 inch hole, the flat bottom of the 15 inch hole is exposed and can be viewed by the players as they retrieve their golf balls from the hole. The exposed bottom of the 15 inch hole will provide the operators of golf courses, and other interested parties, the opportunity for advertising, labeling, and displays of logos and trademarks. The opportunity for advertising, labeling, and displays of logos and trademarks will provide a new potential revenue source to operators of golf courses, and other interested parties. The invention includes a flat messaging disk made from a water resistant or water proof plastic or laminated paper. Advertising, labeling, text, messages, logos, trademarks, golf course names, customized messages for special or charitable events can be printed on both sides of the messaging disk. The same messaging disk can be used for two different messages by flipping the messaging disk to expose either side. The messaging disk is inserted into the 15 inch cup and rests horizontally against the flat bottom of the 15 inch cup.

In one aspect, disclosed herein are adjustable golf cups comprising: a dual diameter cup base comprising a large golf cup and a standard golf cup positioned within and concentrically with the large golf cup; a cup insert reversibly insertable into the cup base, the cup insert forming an interior and having an upper surface, the upper surface flat and puttable; wherein, when the cup insert is inserted into the cup base, the standard golf cup of the cup base passes through the cup insert and remains open, the opening of the large golf cup is entirely occluded, and the upper surface is flush with the top of the cup base. In some embodiments, the upper surface is natural grass and the interior of the cup insert contains a substrate supporting the growth of the grass. In other embodiments, the upper surface is artificial turf. In further embodiments, the upper surface comprises printed advertising. In some embodiments, the cup base further comprises a flag pole receptacle positioned within the standard golf cup and concentrically with the large golf cup and the standard golf cup. In some embodiments, the standard golf cup has a diameter of about 4.25 inches. In some embodiments, the large golf cup has a diameter of about 15 inches. In some embodiments, the adjustable golf cup further comprises a disk reversibly insertable into the cup base, wherein, when the disk is inserted into the cup base, the standard golf cup passes though the disk and the disk covers the bottom of the large golf cup. In further embodiments, the disk comprises an impact absorbing material. In other embodiments, the disk comprises printed advertising.

DETAILED DESCRIPTION OF THE INVENTION

Described herein, in certain embodiments, are adjustable golf cups comprising: a dual diameter cup base comprising a large golf cup and a standard golf cup positioned within and concentrically with the large golf cup; a cup insert reversibly insertable into the cup base, the cup insert forming an interior and having an upper surface, the upper surface flat and puttable; wherein, when the cup insert is inserted into the cup base, the standard golf cup of the cup base passes through the cup insert and remains open, the opening of the large golf cup is entirely occluded, and the upper surface is flush with the top of the cup base.

Certain Definitions

Unless otherwise defined, all technical terms used herein have the same meaning as commonly understood by one of ordinary skill in the art to which this invention belongs. As used in this specification and the appended claims, the singular forms "a," "an," and "the" include plural references unless the context clearly dictates otherwise. Any reference to "or" herein is intended to encompass "and/or" unless otherwise stated.

Overview

Figure 1:
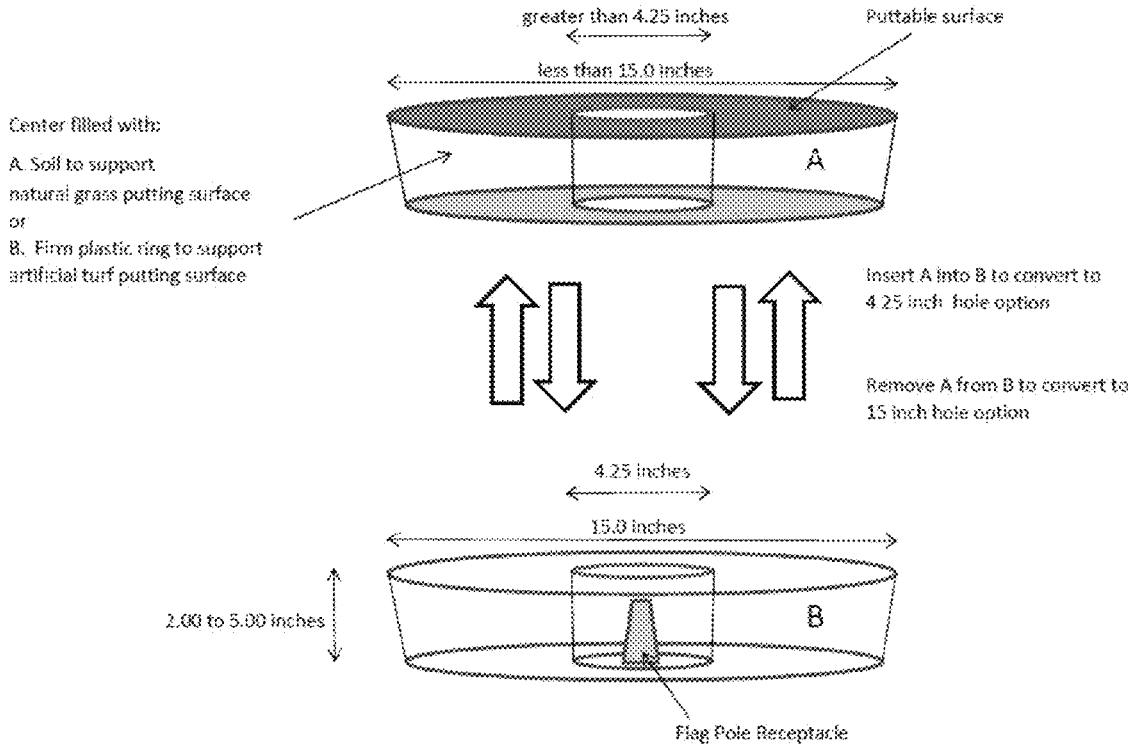
FIG. 1 shows a non-limiting example of an adjustable golf cup; in this case, an adjustable golf cup comprising two main parts, Part A and Part B. Part A is a puttable surface ring that is inserted into Part B to create a 4.25 inch golf hole. Part A is removed from Part B to create a 15 inch golf hole.

Referring to FIG. 1, in a particular embodiment, the subject matter described herein comprises two main parts, Part A and Part B. In this embodiment, Part A is slightly smaller than Part B and is inserted into Part B to create a 4.25 inch golf hole option. Part A is optionally removed from Part B to create a 15 inch golf hole. Further, in this embodiment, Part A has a puttable surface covering the top. If the puttable surface is natural grass, then the supporting fill will be compact soil. The amount of compact soil will provide the necessary height to make the puttable surface flush and even with the surrounding putting green. A heavy lawn roller may be used to insure a flush fit. The natural grass and supporting fill may be sourced from the material cut from the putting green when installing the invention. If the puttable surface is constructed of artificial turf, then the supporting fill under the artificial turf will be a rigid plastic ring. In this embodiment, the plastic ring provides the necessary height to make the puttable surface flush and even with the surrounding putting green. Part B is optionally placed in the ground with the top edge of the 15 inch hole just below the ground level. In this embodiment, Part B contains a 4.25 inch golf cup in the center of Part B. When Part A is inserted down into Part B, the 4.25 inch golf cup becomes the 4.25 inch target hole for the golfers. The puttable surface extends the surrounding putting green to the 4.25 inch golf cup by providing an uninterrupted path for the golf ball to roll to the 4.25 inch hole. Inside the 4.25 inch golf cup is a flag pole receptacle.

Figure 2:
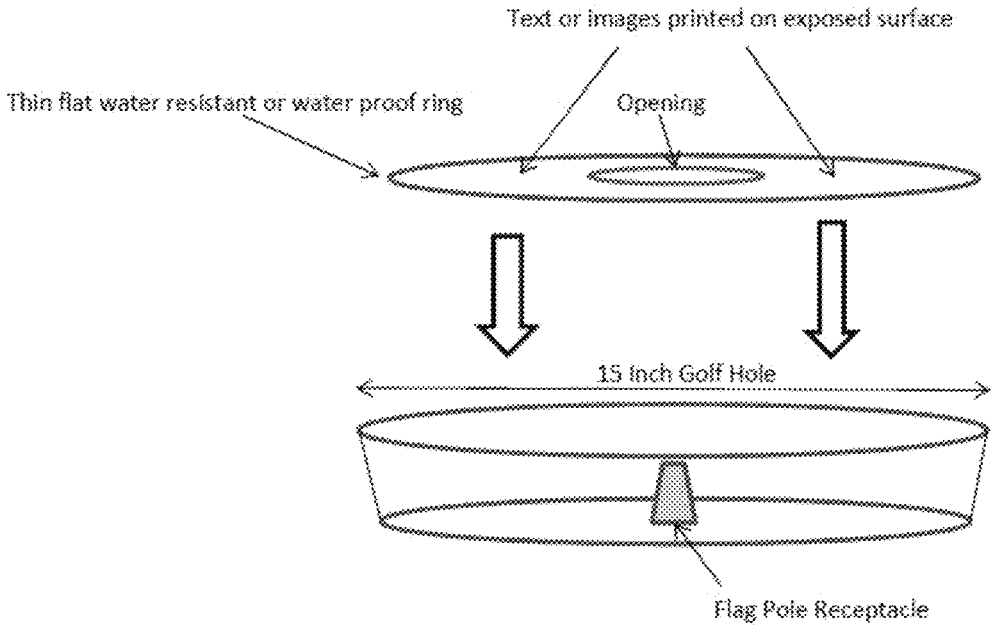
FIG. 2 shows a non-limiting example of a messaging disk; in this case, a messaging disk comprising a thin, water resistant or water proof ring that can be dropped or placed into the bottom of the 15 inch golf cup.

Referring to FIG. 2, in a particular embodiment, the subject matter described herein comprises a water resistant or water proof ring that can be dropped in or placed flat into the bottom of the 15 inch golf cup. In this embodiment, the center of the messaging disk is open to allow for a 4.25 inch golf cup or just for a flag pole receptacle that holds the flag pole vertically in place. The disk is smaller than the 15 inch cup and smaller than the flat bottom of the 15 inch cup. Further, in this embodiment, text or images are printed on the exposed surface of the disk.

Adjustability

In some embodiments, the cup is adjustable. In further embodiments, a larger hole is converted to a smaller golf cup by inserting a puttable surface ring into the larger hole. In a particular embodiment, a 15 inch hole is converted to a 4.25 inch golf cup by inserting a puttable surface ring into the 15 inch hole. Many golf cup sizes are suitable including about 4, 4.25, 5, 6, 7, 8, 9, 10, 11, 12, 13, 14, 15, 16, 17, 18, 19, 20, 21, 22, 23, and 24 or more inches, including increments therein.

In some embodiments, a puttable surface ring extends the surface of the putting green to the edge of a 4.25 inch golf cup. In further embodiments, the puttable surface ring is flush and level with the existing putting green to minimize the impact of the transition from the putting green to the puttable surface ring that surrounds the 4.25 inch golf cup. In some embodiments, the 4.25 inch golf cup is converted to the 15 inch hole cup by removing the puttable surface ring.

Puttable Surface

In some embodiments, the cup includes a puttable surface. As used herein, "puttable" refers to a surface that has a similar impact on the speed and trajectory of a golf ball as to the impact that a typical putting green would have on the speed and trajectory of a golf ball after it is struck by a golfer.

In some embodiments, when the adjustable golf cup is adjusted to the 4.25 inch hole size, there exists a circular area around the hole that extends from the edge of the 4.25 inch hole out approximately 5.375 inches, or to where the edge of the 15 inch hole would be if the hole were converted to the 15 inch hole option. In such embodiments, this circular area is a puttable surface that is removed when the 4.25 inch hole is converted to the 15 inch hole. The puttable surface can, by way of non-limiting examples, take the following forms or options. A first form or option is natural grass and the second form or option is artificial turf. The first option is natural grass that is consistent with the variety of the surrounding putting green. The natural grass will be rooted in soil and when in place with 4.25 inch hole option, can be mowed, watered and/or maintained in a consistent manner with the surrounding putting green. A second option is an artificial grass that simulates the surrounding natural grass and is suitable for putting. Both options will provide a surface that will be the same height and flush with the surrounding putting green. In some embodiments, transition between the surrounding putting green and the puttable surface is minimal with a flush, tight fit so the path of a golf ball will not be materially disturbed as it crosses the transition.

Insert Disk

In some embodiments, the cup includes a flat insert disk. In further embodiments, the insert disk is inserted into the large cup and rests horizontally against the flat bottom of the large cup.

In some embodiments, the disk is a messaging disk and comprises advertising. For example, when converted to a large hole, the flat bottom of the large hole is exposed and can be viewed by the players as they retrieve their golf balls from the hole. The exposed bottom of the large hole provides the operators of golf courses, and other interested parties, the opportunity for advertising, labeling, and displays of logos and trademarks. The opportunity for advertising, labeling, and displays of logos and trademarks will provide a new potential revenue source to operators of golf courses, and other interested parties.

In some embodiments, the disk is made from a water resistant or water proof plastic or laminated paper. Advertising, labeling, text, messages, logos, trademarks, golf course names, customized messages for special or charitable events are optionally printed on one or both sides of the messaging disk. The same messaging disk is optionally used for two different messages by flipping the messaging disk to expose either side.

In some embodiments, the disk is an impact absorbing disk. In further embodiments, the disk optionally contains a pocket that can be filled with sand, water or another impact absorbing material. In other embodiments, the disk itself is constructed of an impact absorbing material. In such embodiments, the absorbing material within the messaging disk serves two functions. One function is to absorb the impact of a golf ball that is stuck by a golfer and that drops down vertically into the bottom of the larger size golf cup. The second function is to add additional weight to the messaging disk so that it remains firmly in place at the bottom of the large golf cup, which may be especially useful in the case of windy conditions. If the golfer is fortunate enough to hit the golf ball on target and the golf ball falls directly into the large cup, the golf ball may bounce off the flat rigid bottom of the large cup and fly back out of the hole. One of the exciting aspects of the game of golf is to achieve a "hole-in-one." The impact absorbing messaging disk would prevent the ball from bouncing out of the cup and would help preserve the exciting prospect of achieving a hole-in-one. In fact, the impact absorption of the messaging disk would help keep the golf ball in the target cup in any circumstance where the golf ball falls down vertically into the 15 inch golf cup.

A golf course operator optionally leaves the impact absorbing messaging disk blank, without an image or text, but still may want it placed in the bottom of the large cups so that the golfers playing on the course may still enjoy its functional benefits.

In some embodiments, the insert disk is both a messaging disk and an impact absorbing disk.

EXAMPLES

The following illustrative examples are representative of embodiments of the subject matter described herein and are not meant to be limiting in any way.

Example 1

A beginning golfer is playing on a day and time that the operators of the golf course have chosen to designate as a "relaxed" day, where the holes are all converted to the 15 inch cup size. For a beginning golfer, the 15 inch golf cup provides an appropriate level of difficulty and the beginning golfer is able to complete the game within a reasonable amount of time. This faster pace of play is a benefit to both the beginning golfer and the operators of the golf course. An advanced golfer is playing on a day and time that the operators of the golf course have chosen to designate as a "traditional" day, where the holes are all converted to the 4.25 inch cup size. For an advanced golfer, the 4.25 inch golf cup provides an appropriate level of difficulty. The advanced golfer feels challenged but is able to complete the game within a reasonable amount of time. Again, providing a benefit to both the golfer and the operators of the golf course. Both the beginning golfer and the advanced golfer enjoy the course at their own level and without the risk of tripping on the second hole that is cut into the putting green.

Example 2

A golfer approaches the putting green enjoining the bucolic aesthetic that the golf course operators wish to preserve. Prior to arriving at the putting green, the golfer has been unable to see the adverting or messaging that is resting flat at the bottom of the 15 inch golf cup. When the golfer walks closer toward the 15 inch golf cup to retrieve his/her ball, the golfer is able to see the advertising. The advertising effectively reaches the golfer, but does not impact the aesthetic experience of the game.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention.

What is claimed is:

1. An adjustable golf cup comprising:

a. a dual diameter cup base comprising a large golf cup and a standard golf cup positioned within and concentrically with the large golf cup;

b. a cup insert reversibly insertable into the cup base, the cup insert forming an interior and having an upper surface, the upper surface flat and puttable;

wherein the upper surface is natural grass and the interior of the cup insert contains a substrate supporting the growth of the grass;

wherein, when the cup insert is inserted into the cup base, the standard golf cup of the cup base passes through the cup insert and remains open, the opening of the large golf cup is entirely occluded, and the upper surface is flush with the top of the cup base.

2. The adjustable golf cup of claim 1, wherein the cup base further comprises a flag pole receptacle positioned within the standard golf cup and concentrically with the large golf cup and the standard golf cup.

3. The adjustable golf cup of claim 1, wherein the standard golf cup has a diameter of about 4.25 inches.

4. The adjustable golf cup of claim 1, wherein the large golf cup has a diameter of about 15 inches.

5. The adjustable golf cup of claim 1, further comprising a disk reversibly insertable into the cup base, wherein, when the disk is inserted into the cup base, the standard golf cup or the flag pole receptacle passes through the disk and the disk covers the bottom of the large golf cup.

6. The adjustable golf cup of claim 5, wherein the disk comprises an impact absorbing material.

7. The adjustable golf cup of claim 5, wherein the disk comprises printed advertising.

8. An adjustable golf cup comprising:

a. a dual diameter cup base comprising a large golf cup and a standard golf cup positioned within and concentrically with the large golf cup;

b. a cup insert reversibly insertable into the cup base, the cup insert forming an interior and having an upper surface, the upper surface flat and puttable;

wherein the upper surface is artificial turf;

wherein, when the cup insert is inserted into the cup base, the standard golf cup of the cup base passes through the cup insert and remains open, the opening of the large golf cup is entirely occluded, and the upper surface is flush with the top of the cup base.

9. The adjustable golf cup of claim 8, wherein the cup base further comprises a flag pole receptacle positioned within the standard golf cup and concentrically with the large golf cup and the standard golf cup.

10. The adjustable golf cup of claim 8, wherein the standard golf cup has a diameter of about 4.25 inches.

11. The adjustable golf cup of claim 8, wherein the large golf cup has a diameter of about 15 inches.

12. The adjustable golf cup of claim 8, further comprising a disk reversibly insertable into the cup base, wherein, when the disk is inserted into the cup base, the standard golf cup or the flag pole receptacle passes through the disk and the disk covers the bottom of the large golf cup.

13. The adjustable golf cup of claim 12, wherein the disk comprises an impact absorbing material.

14. The adjustable golf cup of claim 12, wherein the disk comprises printed advertising.

* * * * *